US012415249B2

(12) United States Patent
Kavander et al.

(10) Patent No.: US 12,415,249 B2
(45) Date of Patent: Sep. 16, 2025

(54) ABRASIVE PRODUCT

(71) Applicant: Mirka Ltd, Jepua (FI)

(72) Inventors: Christer Kavander, Nykarleby (FI); Courtney Hede, Vöyri (FI); Anders Häggblom, Hirvlax (FI); Jan Grön, Vörå (FI)

(73) Assignee: Mirka Ltd, Jepua (FI)

( * ) Notice: Subject to any disclaimer, the term of this patent is extended or adjusted under 35 U.S.C. 154(b) by 0 days.

(21) Appl. No.: 18/712,489

(22) PCT Filed: Jun. 3, 2022

(86) PCT No.: PCT/FI2022/050382
§ 371 (c)(1),
(2) Date: May 22, 2024

(87) PCT Pub. No.: WO2023/094721
PCT Pub. Date: Jun. 1, 2023

(65) Prior Publication Data

US 2024/0416485 A1 Dec. 19, 2024

(30) Foreign Application Priority Data

Nov. 25, 2021 (FI) ..... 20216207

(51) Int. Cl.
*B24D 11/02* (2006.01)
*B24D 11/00* (2006.01)

(52) U.S. Cl.
CPC ..... *B24D 11/02* (2013.01); *B24D 11/005* (2013.01); *B24D 11/008* (2013.01)

(58) Field of Classification Search
CPC ..... B24D 11/001; B24D 11/02; B24D 11/008; B24D 11/005; B24D 11/08; B24D 11/065; B24D 18/00
(Continued)

(56) References Cited

U.S. PATENT DOCUMENTS

2003/0207652 A1* 11/2003 Bates ..... B24B 45/00 451/6
2005/0130536 A1* 6/2005 Siebers ..... B32B 5/06 442/381
(Continued)

FOREIGN PATENT DOCUMENTS

EP 3587641 A1 1/2020
FI 130281 B 6/2023
(Continued)

OTHER PUBLICATIONS

Opinion on Patentability dated Feb. 25, 2022, in corresponding Finnish U.S. Appl. No. 20/216,207, Finnish Patent and Registration Office, 5 pages.
(Continued)

*Primary Examiner* — Brian D Keller
*Assistant Examiner* — Marcel T Dion
(74) *Attorney, Agent, or Firm* — ArentFox Schiff LLP

(57) ABSTRACT

This specification relates to a solution for overcoming the problem of loose loops formed by cutting the abrasive products. A method of obtaining an abrasive product (100) is provided. The method comprises providing a substrate (101, 201, 301) having a first surface (101*a*, 201*a*, 301*a*) and a second surface (101*b*, 201*b*, 301*b*, 501*b*), providing abrasives (102, 202, 302) on the first surface (101*a*, 201*a*, 301*a*) of the substrate and providing loops (103, 203, 303) on the second surface (101*b*, 201*b*, 301*b*, 501*b*) of the substrate. The method further comprises providing a melted and/or burnt area (304, 404, 504) on the second surface (101*b*, 201*b*, 301*b*, 501*b*) of the substrate by melting and/or burning the loops, and cutting the substrate (101, 201, 301) in order to provide the abrasive product (100). Further, the abrasive product (100) is provided.

8 Claims, 5 Drawing Sheets

(58) Field of Classification Search
USPC ..... 451/532, 533, 536, 539
See application file for complete search history.

(56) References Cited

U.S. PATENT DOCUMENTS

| | | | | |
|---|---|---|---|---|
| 2005/0227600 | A1* | 10/2005 | Fisher | B24D 9/085 451/538 |
| 2007/0037488 | A1* | 2/2007 | Saikin | B24D 11/008 451/6 |
| 2008/0216413 | A1* | 9/2008 | Woo | B24D 3/002 51/295 |
| 2011/0053476 | A1* | 3/2011 | Beyer | B24D 11/001 451/539 |
| 2012/0122383 | A1* | 5/2012 | Woo | B41M 5/267 451/540 |
| 2015/0004891 | A1* | 1/2015 | Seth | B24D 11/00 51/293 |
| 2023/0226665 | A1* | 7/2023 | Mahli | B24D 11/005 51/295 |

FOREIGN PATENT DOCUMENTS

| | | | |
|---|---|---|---|
| WO | 9607509 | A1 | 3/1996 |
| WO | 2014037034 | A1 | 3/2014 |
| WO | 2020186232 | A1 | 9/2020 |

OTHER PUBLICATIONS

International Search Report and Written Opinion in PCT/FI2022/050382, mailed Jan. 19, 2023, 8 pages.

* cited by examiner

ABRASIVE PRODUCT

CROSS-REFERENCE TO RELATED APPLICATIONS

This application is a National Phase of PCT/FI2022/050382, filed on Jun. 3, 2022, which claims priority to Finnish Patent Application No. 20216207, filed on Nov. 25, 2021, the disclosures of each of which are hereby incorporated by reference in their entireties.

TECHNICAL FIELD

This specification relates to an abrasive product and a manufacturing method thereof.

BACKGROUND

Hook and loop fastening systems are often utilized for reliable attachment of abrasive products to the corresponding support on grinding machines and tools. The "hooks" are commonly arranged at the machine side (by means of a suitable backing pad or hook surface), while the loops are provided by the abrasive product.

In manufacturing, when cutting the abrasive products with loop fastening loose loops are formed. When punching out the abrasive products, the loops at the edge(s) of the abrasive product are cut off by the cutting tool and subsequently stick to the abrasive product, contaminating it. These loose loops on the abrasive product may fall off during the grinding operation when the abrasive products are used and may cause problems by contaminating the grinded object. Several attempts have been made in order to minimize the amount of the loose loops. A net cleaner device exploiting pressurized air and suction may be used after the mechanical punching process. However, in some cases this may not be able to remove enough loose loops to perfectly satisfy the end user. Alternatively, a tacky layer against the loop side of the abrasive product may be applied. However, this results in extra costs and is not convenient from the end user's perspective, as the tacky layer must be manually removed prior to use.

SUMMARY

A solution to the problem of loose loops formed by cutting the abrasive products may be overcome by applying the solution disclosed herein. Disclosed solution herein is implementable for abrasive products comprising loops that enable the attachment of the abrasive product by a hook and loop fastening system, the loops comprising or consisting of material that can be melted and/or burnt to cause the loop structure to lose its original form.

According to an embodiment, a method of obtaining an abrasive product is provided. The method comprises

- providing a substrate having a first surface and a second surface,
- providing abrasives on the first surface of the substrate,
- providing loops on the second surface of the substrate,
- providing a melted and/or burnt area on the second surface of the substrate by melting and/or burning the loops, and
- cutting the substrate in order to provide the abrasive product.

According to another embodiment, an abrasive product is provided. The abrasive product comprises a substrate having a first surface and a second surface. The first surface of the substrate comprises abrasives. The second surface of the substrate comprises loops. The abrasive product further comprises a melted and/or burnt area on the second surface of the substrate, next to the edge of the abrasive product. The melted and/or burnt area has a width of at least 1 mm.

Figure 1:
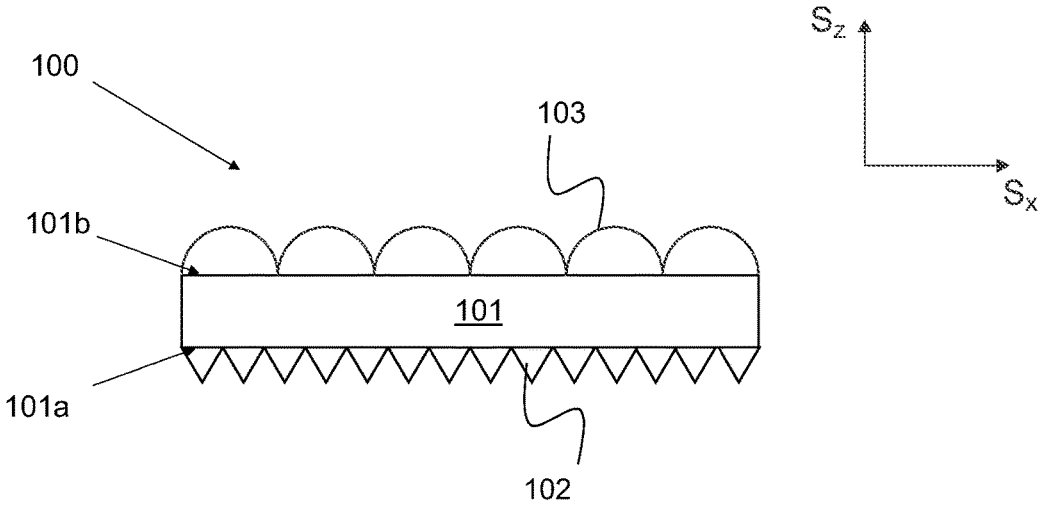
FIG. 1 illustrates, by way of an example, a cross section of an abrasive product.

The FIGS. 1-5*a* are schematic. The figures are not in any particular scale.

DETAILED DESCRIPTION

The solution is described in the following in more detail with reference to some embodiments, which shall not be regarded as limiting.

Within context of this specification term "comprising" may be used as an open term, but it also comprises the closed term "consisting of". The following reference numbers are used in this specification:

100 abrasive product
101, 201, 301 substrate
101*a*, 201*a*, 301*a* first surface (of the substrate)
101*b*, 201*b*, 301*b*, 501*b* second surface (of the substrate)
102, 202, 302 abrasives
103, 203, 303 loops
203*a*, 403*a* loose loop
304, 404, 504 melted and/or burnt area
205, 305, 405 cut line
310, 510 abrasive web Abrasive products may be used in different applications, such as automotive industry, ships and boats, building and construction sites, and composites industry, to name of few. The applications for abrasive products may include various materials, such as wood, metal, putties, composites, plastics, minerals or different coatings such as primers, paints or varnishes. Common abrasive methods may comprise for example grinding, polishing, buffing, honing, cutting, drilling, sharpening, lapping or sanding. When the surface shape of the object to be abraded is not planar and comprises height deviations, it is desirable that the abrasive product is flexible. A flexible abrasive product adapts better to the shape of the surface being abraded. Abrasive products may be used for example in wet or dry conditions, depending on the purpose.

An abrasive product refers to an article which may be used for abrasion. The abrasive product may be shaped from an abrasive web by cutting. Multiple abrasive products may be shaped from an abrasive web by cutting. The abrasive product may have any suitable shape, such as circular, triangular, polygonal, quadrangular, rectangular, hexagonal or oval. A circular abrasive product may be called a disc. A quadrangular or rectangular abrasive product may be called a sheet. The shape of the abrasive product corresponds to the shape of grinding machine, or a support such as a hand held pad or a grip surface thereof. The abrasive product may also be an abrasive belt. The abrasive belt refers to a product that may be mountable for example on rotating wheels or axles. The abrasive product also may be a roll product. From the roll product separate abrasive sheets may be detachable via e.g. a line of weakness arranged between subsequent sheets.

The abrasive product generally comprises abrasive material, referred to as abrasives or abrasive grains or abrasive particles. Typically the abrasives are bound to a substrate with resin(s). Typical materials used as abrasives are hard minerals, which may be synthetic or occur naturally. An exemplary list of minerals used as abrasives comprises cubic boron nitride, boron carbide, aluminium oxide, iron oxide, cerium oxide, silicon carbide, zirconia alumina, diamond, emery and corundum. Furthermore, abrasive grains may comprise ceramic grains or engineered grains. Engineered grains refers to abrasive grains shaped to a certain shape and size.

The abrasive product comprises a substrate having a first surface and a second surface.

The substrate may comprise or consist of a continuous layer. Continuous layer may originally have a 100% coverage with no holes in it. The continuous layer may comprise for example paper, polymer film, woven fabric or non-woven fabric. The continuous layer of the substrate may be a monolayer or it may comprise multiple layers.

Alternatively, the substrate may comprise or consist of an open cloth of knitted, woven or non-woven fabric. The fabric forming the basis of the abrasive product may be for example a weft-knitted jersey-based fabric, weft-knitted double layer jersey-based fabric, weft-knitted rib-based fabric, weft-knitted purl-based fabric, warp-knitted jersey-based fabric, warp-knitted double layer jersey-based fabric, warp-knitted rib-based fabric, warp-knitted purl-based fabric or combined warp- and weft-knitted jersey-based fabric. The open cloth of non-woven fabric may comprise fluffy, felt-type material. It is important that the open cloth contains open spaces or regions defined for instance by loops or meshes. The open structure of the cloth allows removing grinding dust from the surface of the abrasive product. The substrate may consist of a knitted net pile fabric.

The substrate should be at the same time both flexible to conform to the surface to be abraded and durable to withstand use in machine abrasion and/or hand abrasion. Durable in this respect refers to tensile strength and bending stiffness or elongation strength of the substrate.

An illustrative example of an abrasive product 100 is shown in FIG. 1. The abrasive product comprises a substrate 101. The substrate 101 has a first surface 101*a* and a second surface 101*b*. The first surface 101*a* may also be called a lower surface. The second surface 101*b* may also be called an upper surface. The first surface 101*a* of the substrate comprises abrasives 102. Fixation of the abrasives 102 may be achieved by coating. The second surface 101*b* of the substrate comprises loops 103. The loops 103 enable reliable attachment of the abrasive product 100 to a corresponding support on a grinding machine by a hook and loop fastening system.

The second surface 101*b* of the substrate comprises a plurality of loops 103 protruding from the second surface of the substrate. The loops 103 have protruding heads. The protruding heads may have contour lengths of from 2 mm to 50 mm, for example from 2 mm to 10 mm. Loops 103 may be formed by loop yarns which are interlaced in a cloth or textile. Alternatively the loops may be formed by pulling under or overlappings out from a cloth or textile. The loop yarns and the yarns of the cloth or textile may be made of different kinds of yarn.

The yarns forming the loops may comprise or consist of a synthetic thermoplastic. A thermoplastic (or thermosoftening plastic) is a plastic polymer material that becomes pliable or moldable at a certain elevated temperature and solidifies upon cooling. The yarns forming the loops may comprise or consist of for example polyamide (PA), polyester (PES), polypropylene (PP), polyethylene (PE) or polylactic acid (PLA). The yarns forming the loops may comprise or consist of cotton fibers or cellulose-based fibers. Within context of this specification, the yarns forming the loops comprise or consist of material that can be melted and/or burnt to cause the loop structure to lose its original form.

Figure 2:
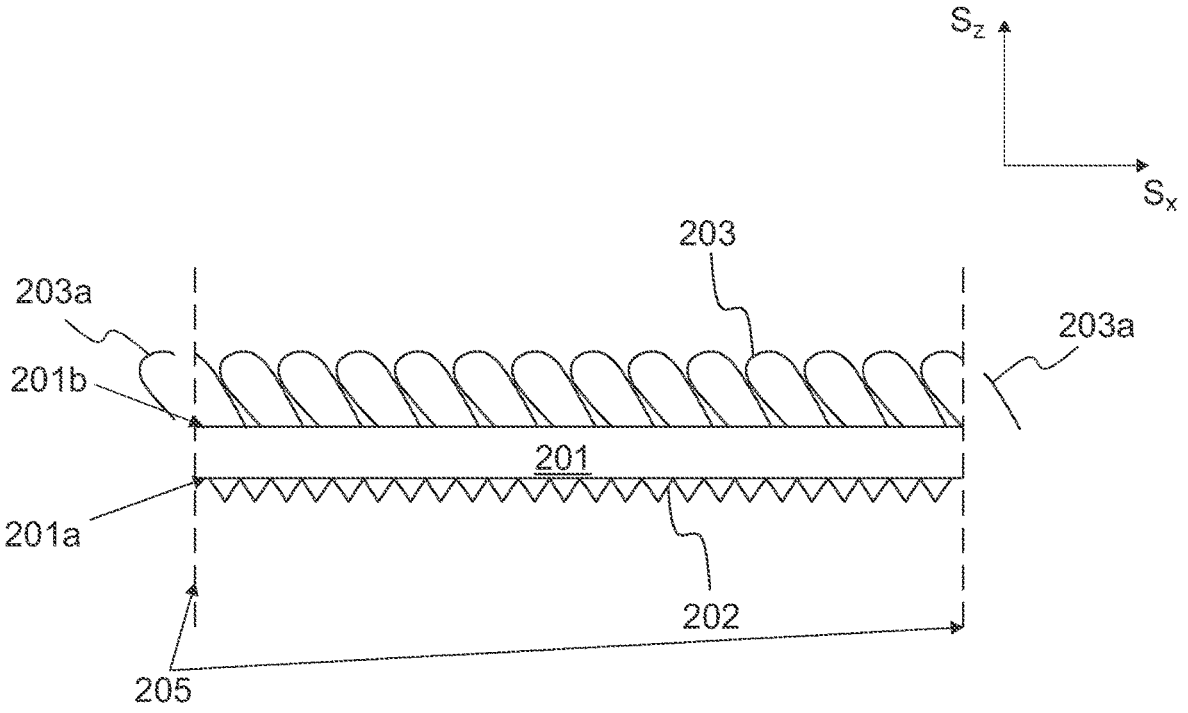
FIG. 2 illustrates, by way of an example, defects related to the conventional method for providing an abrasive product.

The abrasive product is manufactured from an abrasive web by a cutting process. The loops at the cut edge(s) of the abrasive product and half loops become loose because of the cutting process, as is illustrated in FIG. 2. The term loose loop refers to a partial loop or loop part that, as a result of cutting, is no longer permanently attached to abrasive product or abrasive web. Thus, the loose loops are separate entities that may be responsible for contaminating the abrasive product and may eventually cause problems by contaminating the grinded object. Moreover, the loose loops may result in clogging of the abrasive product.

Within context of this specification, an edge of the abrasive product may refer to a border, rim or boundary line defining the outer dimension(s), i.e. the periphery of the abrasive product. Also, the edge may refer to a border, rim or boundary line defining an opening or aperture arranged in the abrasive product. The term "cut edge" refers to the edge of the abrasive product produced by cutting.

This specification aims to provide a solution by which the problem of loose loops may be overcome.

A method of obtaining an abrasive product is provided. The method comprises providing a substrate having a first surface and a second surface. The method further comprises providing abrasives on the first surface of the substrate and providing loops on the second surface of the substrate. A loop referred to herein denotes a structure that is capable for attachment, i.e. engageable with a hook-part of a hook-and-loop fastening system. The loops may be comprised by the substrate itself, i.e. be integrated part of the substrate, or the loops may be provided by laminating a textile comprising loops on the second surface of the substrate.

The substrate may comprise a continuous layer or an open cloth of knitted, woven fabric or non-woven fabric. As mentioned above, the continuous layer may comprise for example paper, polymer film, woven or non-woven fabric. The continuous layer may be a monolayer or comprise multiple layers.

The loops may be provided by laminating a textile comprising loops on the second surface of the substrate. The textile comprising loops may be laminated via an adhesive layer on the second surface of the substrate. The textile comprising loops may be a loop knitted textile, a raised velour textile or a non-woven fabric that comprises loop-type structures available for attachment with hooks. Alternatively, the loops may be comprised by the continuous layer itself. Thus the loops are provided as integrated part of the substrate. This may be the case when the continuous layer is a non-woven, felt-type fabric comprising loop-type structures available for attachment with hooks. The loop-type structures of the non-woven, felt-type fabric may be randomly oriented fibers that enable hook-and-loop type attachment with hooks. In that case the abrasive product does not comprise a separate laminated textile comprising loops.

Loops of the loop knitted textile may be provided by knitting the loops simultaneously with knitting the textile. The knitting may be performed by a warp- or weft knitting machine. Typically two types of yarn are used, one for the textile backing and one for the loop. In case improved grip life is desired it is possible to use two or more yarns or a thicker yarn for the loops. The yarn for the loops can be of multi- or monofilament type. A monofilament yarn typically has a bigger fiber size. Fiber size of the monofilament yarn may be in the range of 20-40 dtex. A multifilament yarn may typically have between 10-30 filaments per yarn. The loop knitted textile may undergo a thermo fixing process step before laminating. The thermo fixing step may also include randomizing the loops with brushing. In an example, the loops yarn of the loop knitted textile may be of 50 dtex/24 filaments PES yarn. A polymer binder for stabilizing the textile better may also be added in relation to the thermo fixing.

Raised velour textile may be knitted with two yarns in the structure. One yarn is for forming the textile and the other yarn will form the loop in a raising process. The two yarns may be of the same kind or of different kinds. The same types of yarns as were discussed above for the loop knitted textile may be used. The process for producing the raised velour textile may comprise knitting, brushing, and thermo fixing. Intermediate steps such as washing and dying may also be included.

The loop knitted textile typically has fewer and longer loops compared to the raised velour textile. The loop knitted textile normally has a direction for the loops, and majority of the loops are leaning in the same direction. This may not be optimal and therefore the thermo fixing step may comprise brushing the loops. The loop of the loop knitted textile has the whole yarn (i.e. all filaments) in the loop. The raised velour textile typically has shorter loops and the loops have more random direction or orientation. The loops in the raised velour textile may be formed of individual filaments that tend to orient in different directions. This is caused by the treatment wherein a mechanical carding roller is pulling out the yarns from the textile for forming the loops.

When cutting out abrasive products the essential difference is that products with loop knitted textile may get a greater number of loose loops contaminating the machinery and the product compared to a product with a raised velour textile.

The open cloth of knitted or woven fabric comprises loops that are provided by knitting them as an integrated part of the substrate, i.e. as an integrated part of the open cloth of knitted or woven fabric. Thus, the substrate itself has projecting loops originating from threads of the open cloth. In an exemplary embodiment each loop may be formed by a pair of bottom-half arcs connected by a protruding head. The loops may be arranged in rows extending in the wale direction of the cloth. The protruding heads of the loops may be interconnected with one another outside of the cloth so as to form rows of interconnected loops, which rows extend in the wale direction of the cloth. The loops may also be provided by a substrate that is a non-woven, felt-type fabric comprising loop-type structures available for attachment with hooks. The loop-type structures of the non-woven, felt-type fabric may be randomly oriented fibers that enable hook-and-loop type attachment with hooks.

The method comprises providing a melted and/or burnt area on the second surface of the substrate. The melted area is provided by melting the loops. The burnt area is provided by burning (away) the loops. Within context of this specification, the burning also includes vaporization. The melted and/or burnt area is provided by directing energy towards the substrate from the side of the second surface of the substrate. The loops of the second surface of the substrate are melted and/or burnt by directing to them energy that is absorbed by the loop material, thus causing the material and the loops to melt and/or burn. The melted and/or burnt area may be provided prior to or after cutting of the abrasive product from the abrasive web, i.e. cutting the substrate. Removal of the cause of melting and/or burning, i.e. the energy source, causes the melted and/or burnt loops, i.e. the melted and/or burnt material thereof, to solidify. This solidifying increases mechanical stability. The melted and/or burnt area has no loops protruding therefrom. The melted and/or burnt area is provided either for defining the area to be cut, i.e. defining edge(s) of the substrate to be cut (melting and/or burning prior to cutting) or for providing a melted and/or burnt edge of a cut abrasive product (cutting prior to melting and/or burning). In case the loops of the second surface of the abrasive product consist of thermoplastic material, the method comprises providing a melted area, whereas in case the loops consist of natural fibers such as cotton fibers or cellulose-based fibers, the method comprises providing a burnt area, as it is not possible to melt the natural fibers. In case the loops of the second surface of the abrasive product comprise both thermoplastic material and natural fibers, the method comprises both melting and burning of the fibers.

Figure 3:
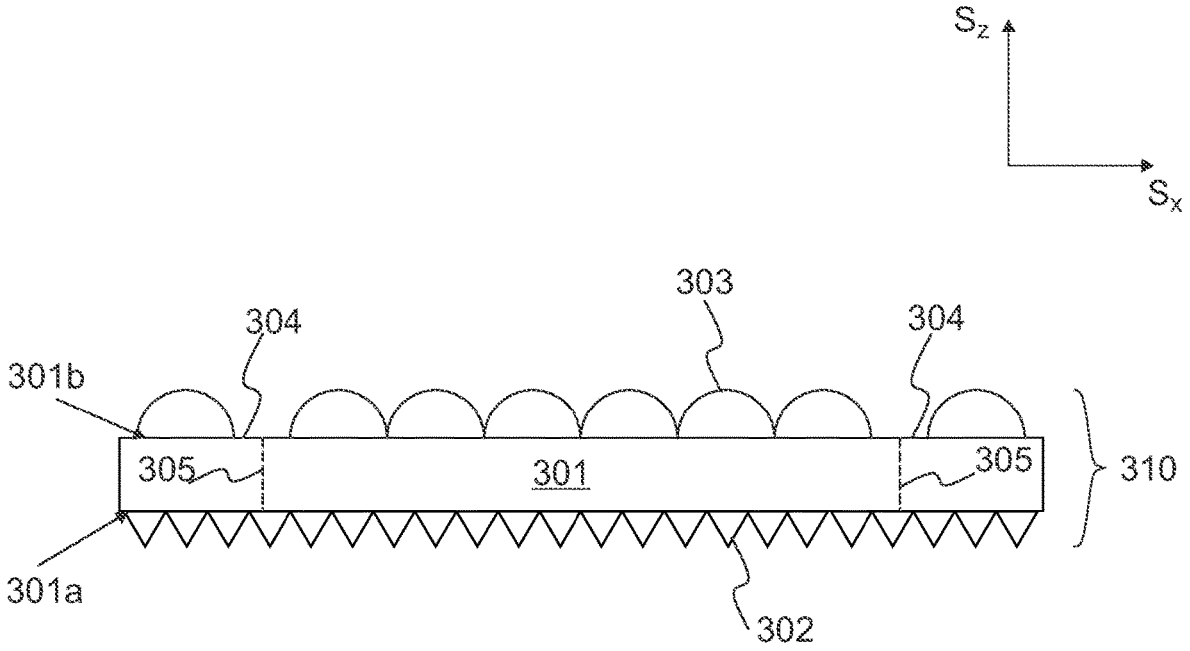
FIG. 3 illustrates, by way of example, a cross section of a part of an abrasive web for providing an abrasive product according to an embodiment.

In case the melted and/or burnt area is provided prior to cutting the substrate in order to provide the abrasive product, the melted and/or burnt area may be called a ditch. A cross section of a part of an abrasive web for providing an abrasive product by providing a melted and/or burnt area 304 prior to cutting is illustrated in FIG. 3. The ditch 304 is a melted and/or burnt flat area having no loops protruding therefrom. Once the cause of the melting and/or burning is removed a ditch 304 comprising solidified or burnt material is obtained. Providing the melted and/or burnt area 304 by melting and/or burning the loops has the effect that the formation of loose loops by the subsequent cutting of the substrate is avoided, or at least minimized, as the ditch area does not comprise loops that would be cut and produce loose loops. The ditch has un-melted or un-burnt loops, i.e. intact loops, on both sides of it, i.e. next to it on the $S_x$, $S_y$-plane. Dashed lines 305 illustrate the cutting lines for providing the abrasive product disclosed herein.

Alternatively, the melted and/or burnt area may be provided after the cutting of the substrate. In that case the melted and/or burnt area is provided next to the cut edge(s) of the abrasive product. The aim is to provide the already cut abrasive product with a melted and/or burnt edge in order to avoid the presence of loose loops.

The melting and/or burning may be performed, i.e. the melted and/or burnt area may be provided, by a laser or ultrasound manufacturing equipment. The melting and/or burning is controlled such so that no cutting is performed, i.e. no perforation(s) penetrating the abrasive product are produced.

An unfocused laser or a laser with weaker strength making many circuits may be utilized for melting and/or burning the loops and for providing the melted and/or burnt area. The aim is only to provide a melted and/or burnt area, not to cut the product. Any laser system capable of melting and/or burning the loops in question is suitable for use. Infrared lasers may be well suited for providing the melted and/or burnt area in case the loops comprise or consist thermoplastics, as thermoplastics typically have high absorption values in the infrared spectral range. UV-lasers may also be used. The operating parameters may, for example, be the power of the laser beam or a combination of the power of the laser beam and the velocity at which the laser beam is moved relative to the abrasive product or abrasive web.

Any infrared laser may be used. The infrared laser may be tunable or fixed wavelength. The infrared laser may be pulsed or continuous wave. The infrared laser may be for example a $CO_2$ laser. The $CO_2$ laser produces a beam of long wave infrared light with the principal wavelength centered between 9.2 and 12 micrometers and tunable within this range. Average output power is typically highest at 10.6 micrometers and declines when tuned to other wavelengths. The laser wavelength used may be matched to the absorption profile of the loop material. The power and/or velocity at which the laser manufacturing equipment is operated may be optimized depending on the material that is being processed.

Melted and/or burnt area may be provided for defining outer edge(s) of the surface to be cut in the abrasive product. Additionally, melted and/or burnt area may be provided for defining circumference of aperture(s) or opening(s) on the abrasive product. The aperture(s) or opening(s) extend through the abrasive product in $S_z$-direction. Such aperture (s) or opening(s) on the abrasive product may be provided for air intake and/or dust removal. Providing the abrasive product with aperture(s) or opening(s) may be beneficial for example in case the substrate of the abrasive product comprises an originally continuous layer. Aperture(s) or opening (s) may be provided to abrasive products comprising an originally continuous layer as a substrate. Typically such aperture(s) or opening(s) are not needed by the abrasive products comprising or consisting of an open cloth of knitted, non-woven or woven fabric as a substrate, as the open structure of such products inherently allows air intake and/or dust removal.

Width of the melted and/or burnt area formed by melting and/or burning the loops, i.e. width of the melted and/or burnt area depends on the loop length. When the melted and/or burnt area is provided prior to cutting the width of the melted and/or burnt area may be for example in a range of from 2 to 20 mm. When the melted and/or burnt area is provided after cutting the width of the melted and/or burnt area may be at least 1 mm, for example from 1 to 10 mm or from 1 to 5 mm. In any case the width of the melted and/or burnt area provided on the second surface of the abrasive product or the abrasive web is wider than what would be the outcome of direct cutting by a laser manufacturing equipment. Direct cutting by a laser manufacturing equipment always causes a certain amount of melting and/or burning in the vicinity of the cutting line. However, typically the melted and/or burnt area caused by direct cutting by a laser manufacturing equipment has a width of less than 1 mm, for example 0.8 mm. Thus, the melted and/or burnt area referred to herein is not obtainable by a conventional laser cutting process only.

The melted and/or burnt area produced by laser manufacturing equipment may be from 1 to 25% of total surface area of the second surface of the substrate of the abrasive product. The percentage of the melted and/or burnt area naturally depends on the width of the melted and/or burnt area as well as on the total surface area of the second surface, i.e. the size of the abrasive product. For example, the melted and/or burnt area may be from 1 to 5%, or from 5 to 15%, or from 15 to 25% of the total surface area of the second surface of the substrate. Surface area of the melted and/or burnt area must be chosen such that reliable attachment of the abrasive product to the corresponding support on grinding machine or tool is enabled, despite of the lacking loops on the edge(s) of the product. On the other hand, the melted and/or burnt area must be wide enough to avoid or at least minimize the formation of loose loops by the subsequent cutting of the substrate. For abrasive products with longer loop lengths, wider melted and/or burnt area may be needed.

The method further comprises cutting the substrate. As already discussed, the cutting may be performed prior to or after providing the melted and/or burnt area. When the cutting is performed after the melted and/or burnt area has been provided, the cutting is performed at the point of the ditch, i.e. the melted and/or burnt area in order to provide the abrasive product. Preferably the cutting is performed close to or at the center line of the melted and/or burnt area, thus ensuring uncut loops. The cutting thus leaves a melted and/or burnt area next to circumferential edge(s) of the second surface of the substrate of the abrasive product. Said melted and/or burnt area may have a width of at least 1 mm, for example from 1 to 10 mm or from 1 to 5 mm. Said width is the outcome of cutting close to or at the center line of the melted and/or burnt area originally having a width of from 2 to 20 mm.

The cutting may be mechanical cutting, laser cutting or ultrasound cutting. The mechanical cutting may be die cutting, roller die cutting or flatbed cutting. The mechanical cutting may be called mechanical punching. Mechanical cutting or laser cutting may be preferred over ultrasound cutting, as the ultrasound cutting may cause a slight damage to the edge that has been cut.

In an embodiment, the cutting is mechanical cutting. In that case the melting and/or burning of the loops is preferably performed prior to the mechanical cutting. If the melting and/or burning is performed after the mechanical cutting, the cut objects, i.e. the abrasive products must be secured during the melting and/or burning process. The method further comprises aligning the melting and/or burning and the mechanical cutting. The aligning may be performed by a system comprising at least one sensor and/or a vision system. Aligning the melting and/or burning may include a step of detecting the location of the melted and/or burnt area, i.e. the ditch, and a step of giving corresponding output to the machine drive that is responsible for the cutting process. A joint trigger marker may be used for aligning all processes, i.e. the melting and/or burning, the aligning and the cutting. A dancer roller may be needed in order to give time for the mechanical cutting unit to align to the melted and/or burnt geometry.

In another embodiment, the cutting is laser cutting. Laser cutting utilizes a focused laser beam to vaporize materials, resulting in a cut edge.

For melting and/or burning and/or cutting by ultrasound manufacturing equipment, an ultrasound manufacturing equipment operating at a frequency range of from 20 to 75 kHz may be utilized. The ultrasound frequency is produced by a generator. The generator converts main voltage into high-frequency high voltage and transfers this to a stack comprising a converter, a booster and a sonotrode. The converter converts the incoming voltage by electrostriction into mechanical oscillations of the same frequency and conducts them via the booster and sonotrode to the workpiece, namely the abrasive web or product herein. Local heating of the workpiece material is thus caused. Ultrasound manufacturing equipment may be used for melting and/or burning and for cutting. Such process produces abrasive product with a melted and/or burnt area on the second surface of the substrate, next to edge of the abrasive product. The melted and/or burnt area typically has a width of below 1 mm. For example, the width of the melted and/or burnt area produced by using ultrasound manufacturing equipment may be from 200 to 500 μm.

Figure 4:
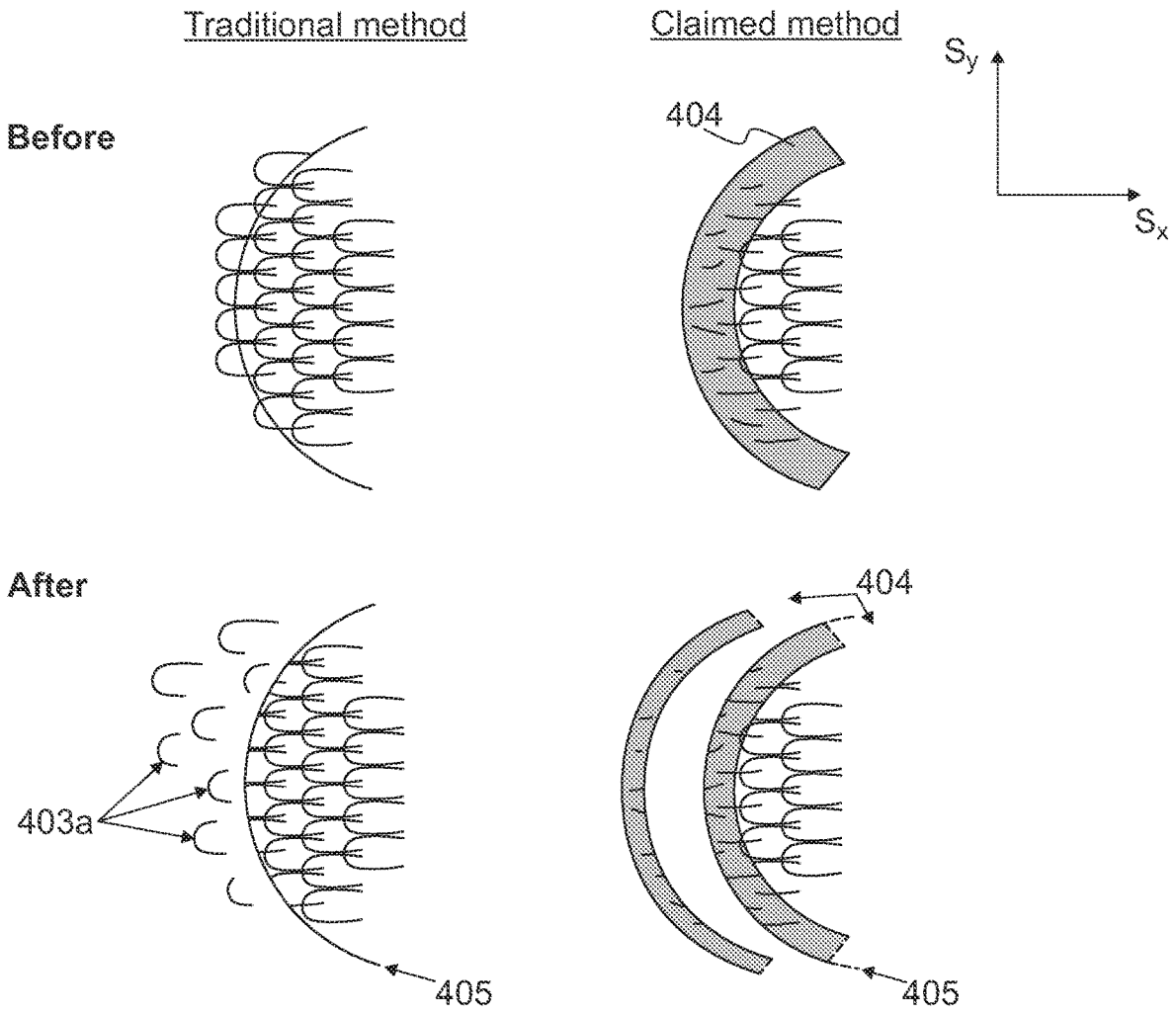
FIG. 4 illustrates, by way of an example, partial views on the second surfaces of the abrasive products before and after traditional cutting and before and after implementing the method disclosed herein.

FIG. 4 illustrates partial views of the second surfaces of the abrasive products viewed from above before and after traditional cutting and before and after implementing the method disclosed herein. For clarity, in drawings of FIG. 4, only the abrasive product to be cut is visualized and (most of) the remaining abrasive web surrounding the abrasive product is omitted. In traditional cutting, the loops residing on the cutting line are cut thus producing loose loop parts. However, when using the method disclosed herein, the loops residing on the cutting line and next to the cutting line are melted and/or burnt to form a melted and/or burnt area having no loops protruding therefrom. Thus, when the abrasive product is cut so that the cutting line is arranged to reside on the melted and/or burnt area, no loose loops are formed, as no loops are cut.

Figure 5A:
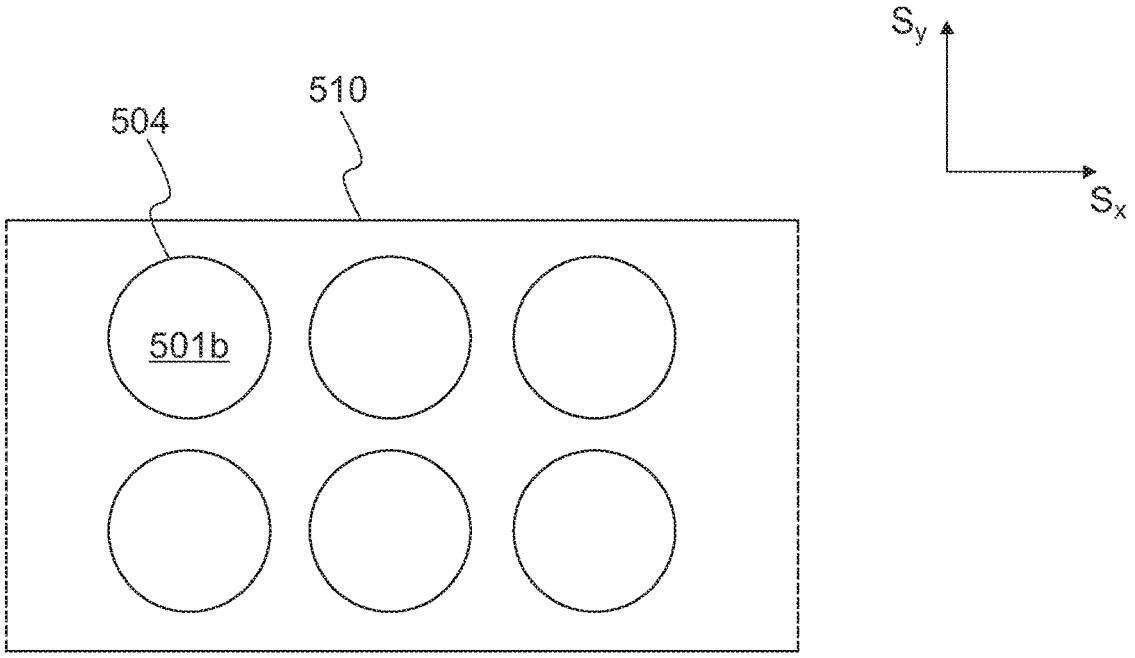
FIG. 5*a* illustrates, by way of an example, an $S_x$, $S_y$-plane view of an abrasive web.
Figure 5B:
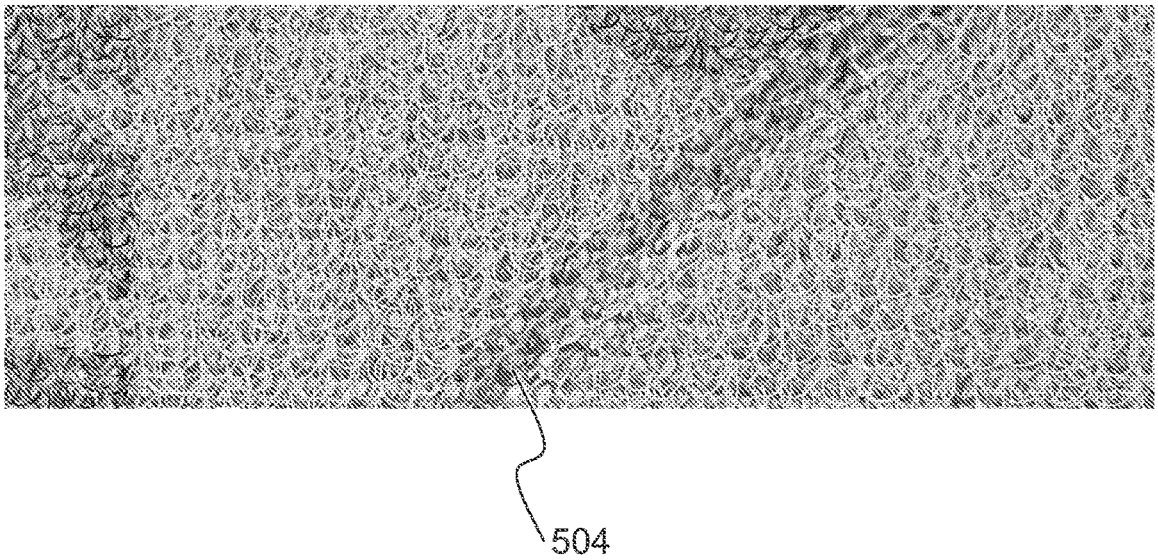
FIG. 5*b* illustrates, by way of an example, a photograph of a section of an abrasive web.

FIG. 5*a* illustrates an $S_x$, $S_y$-plane view of part of an abrasive web 510. The abrasive web 510 comprises melted and/or burnt areas 504 defining edges of the abrasive products to be cut from the abrasive web. FIG. 5*b* illustrates a photograph of a section of the abrasive web, the melted area (ditch) 504 clearly visible on the second surface 501*b* of the abrasive product (abrasive web).

As already discussed above, an abrasive product is provided. The abrasive product disclosed herein may be shaped from an abrasive web by cutting. The abrasive product comprises a substrate having a first surface and a second surface. The first surface of the substrate comprises abrasives and the second surface of the substrate comprises loops. Further details of the substrate, abrasives and loops have been discussed above. The abrasive product further comprises a melted and/or burnt area on the second surface of the substrate, next to edge of the abrasive product. The melted and/or burnt area has a width of at least 1 mm.

The abrasive product comprises the loops as integrated part of the substrate or the loops are comprised by a textile that has been laminated on the second surface of the substrate. The textile comprising the loops may be a loop knitted textile, a raised velour textile or a non-woven fabric.

Abrasive products disclosed herein allow customer demands to be met through the provision of products that are substantially free of loose loops contaminating the abrasive product and eventually the grinded object. Further, use of the impractical tacky layer may be avoided and the abrasive products provided to the customer are ready to be used as such. Also, costs related to the tacky layer usage are avoided. Moreover, as the edge(s) of the abrasive product comprise the melted and/or burnt area which is stronger than the area next to it, mechanical stability of the edge(s) is increased. This prevents fraying of the abrasive product's second surface comprising the loops.

EXAMPLES

In an example, an abrasive product is provided. The substrate of the product consists of a knitted net pile fabric. The loops on the second surface of the substrate are formed as a part of the knitting process. The product has a PA net and PA loops or a PES net and PA loops. The fabric net part, i.e. the first surface of the substrate is impregnated for stabilizing it to a suitable level and flattened to even out the surface of the substrate for the abrasive coating. The abrasive product has a circular shape and a final diameter of 150 mm.

Figure 6:
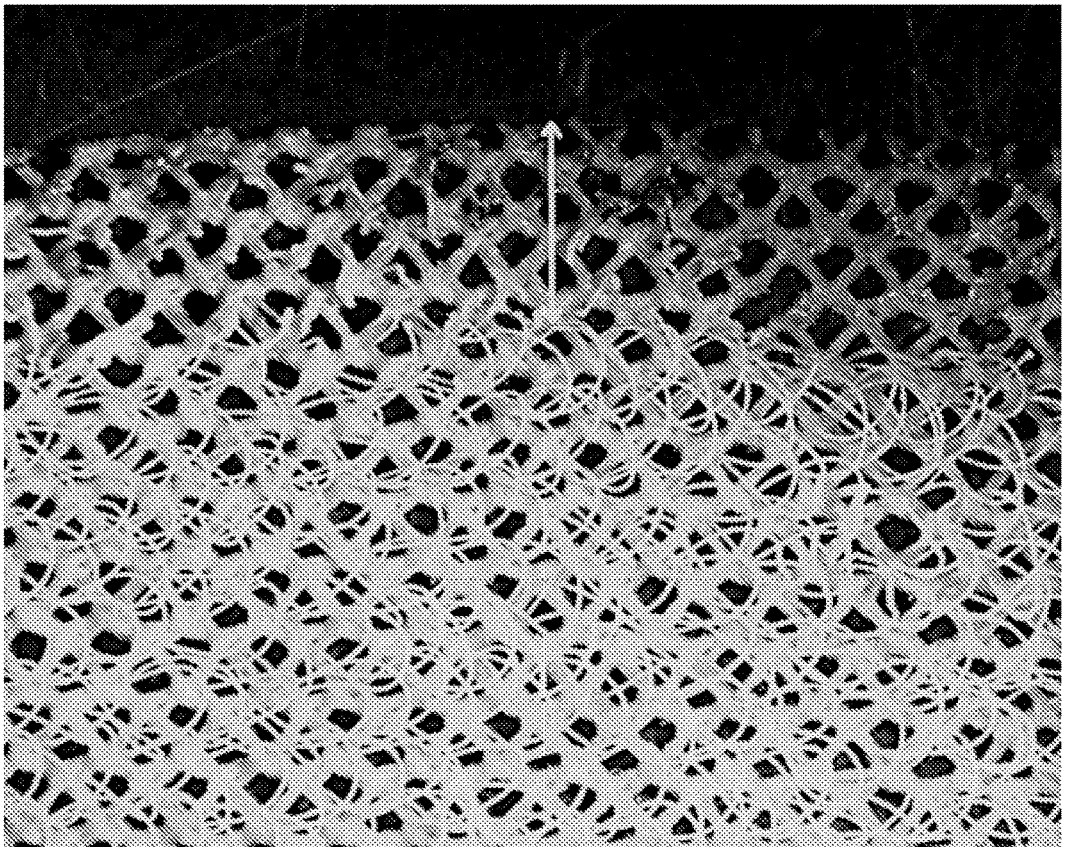
FIG. 6 illustrates, by way of an example, an enlarged photograph of a section of an abrasive product.

The abrasive product is provided at first by way of utilizing weaker strength laser for making several circles around the circular edge of the abrasive product. The weaker strength of the laser is achieved by increasing the speed at which the laser moves, which reduces in only the knitted loop surface being melted, aided by also decreasing the power supplied to the laser. The concentric circles are made first with the weaker strength laser creating a melted or vaporised area of 8 mm in width, 4 mm on the inside of where the cut line will be and 4 mm outside of this cut line. Once this melted area is complete, the laser speed and strength are returned to normal cutting settings and the cutting line is made by the laser. The cutting line is placed in the centre of the melted area, ensuring no loops are present to be cut during the step which cuts the product, separating the abrasive product completely from the web without contamination from loose loops. The resulting abrasive product has a melted area on the second surface of the substrate, next to the circular edge of the abrasive product, the melted area having a width of 4 mm. FIG. 6 shows an enlarged photograph illustrating the melted area. The white two-headed arrow shows the width of the melted area.

Figure 7:
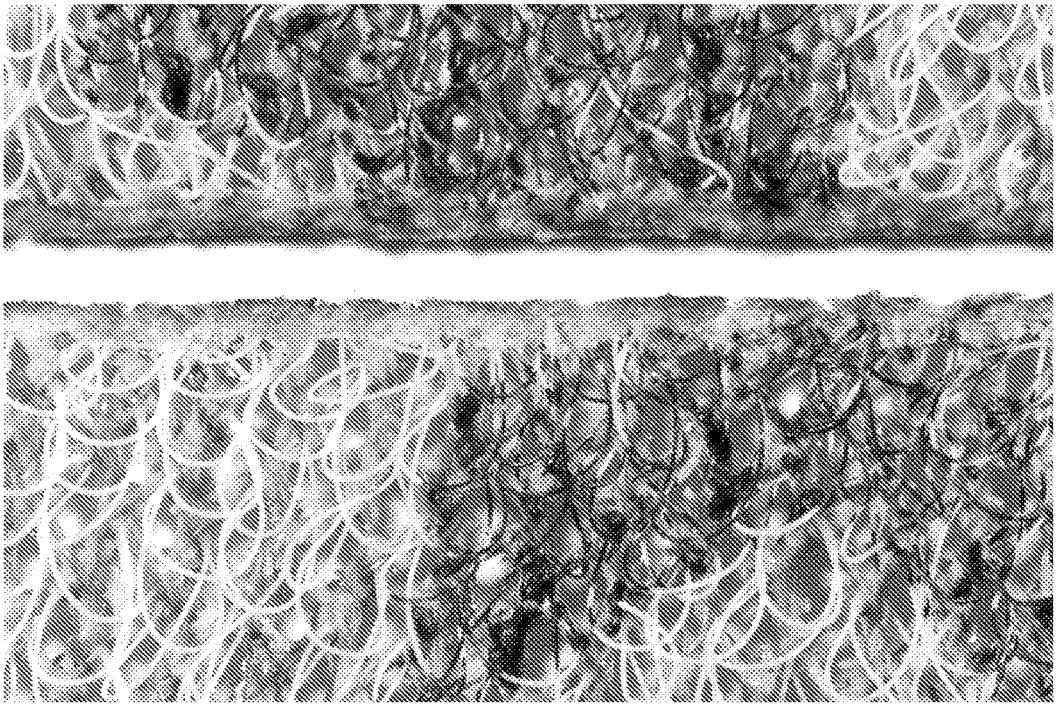
FIG. 7 illustrates, by way of an example, an enlarged photograph of sections of further abrasive products.

FIG. 7 illustrates another example, wherein an abrasive product has been produced by utilizing ultrasound manufacturing equipment for both melting and cutting. The melted area next to the cut edge is visible, but clearly narrower in width when compared to the one produced by laser manufacturing equipment. The substrate of the product of FIG. 7 also consists of a knitted net pile fabric. The loops on the second surface of the substrate are formed as a part of the knitting process. The product has a PA net and PA loops or a PES net and PA loops. The fabric net part, i.e. the first surface of the substrate is impregnated for stabilizing it to a suitable level and flattened to even out the surface of the substrate for the abrasive coating.

The invention claimed is:

1. A method of obtaining an abrasive product, the method comprising:

providing a substrate having a first surface and a second surface, providing abrasives on the first surface of the substrate, providing loops on the second surface of the substrate, providing a melted or burnt area on the second surface of the substrate by melting or burning the loops, comprising controlling the melting or burning such that no perforation or perforations penetrating the substrate are produced, and mechanically cutting the substrate in order to provide the abrasive product, wherein the mechanical cutting is performed via die cutting, roller die cutting or flatbed cutting, wherein the mechanical cutting is performed by a mechanical manufacturing equipment, and wherein the mechanical cutting is performed prior to melting or burning or after melting or burning, the method further comprising:

aligning the melting or burning and the cutting.

2. The method according to claim 1, wherein the melting or burning is performed by a laser or ultrasound manufacturing equipment.

3. The method according to claim 1, wherein the substrate comprises a continuous layer or an open cloth of knitted, non-woven or woven fabric.

4. The method according to claim 1, wherein the loops are provided by laminating a textile comprising loops on the second surface of the substrate or by providing the loops as integrated part of the substrate.

5. The method according to claim 4, wherein the textile comprising loops is a loop knitted textile, a raised velour textile or a non-woven fabric.

6. The method according to claim 1, wherein the melted or burnt area is provided for defining at least one edge of the substrate to be cut or the melted or burnt area is provided in order to provide a melted or burnt edge after the cutting of the substrate.

7. The method according to claim 1, wherein the melted or burnt area is formed by a laser manufacturing equipment.

8. The method according to claim 1, wherein the aligning is performed by at least one sensor or a vision system.

* * * * *